US008021214B2

(12) United States Patent
Guenther et al.

(10) Patent No.: US 8,021,214 B2
(45) Date of Patent: Sep. 20, 2011

(54) HAND-HELD POWER TOOL WITH LOCKING NUT

(75) Inventors: Joachim Guenther, Kaufering (DE); Klaus Nagelschmicd, Germering (DE); Friedemann Moeller, Munich (DE); Roland Mcuer, Ettringen (DE); Thomas Blatz, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 351 days.

(21) Appl. No.: 12/316,359

(22) Filed: Dec. 10, 2008

(65) Prior Publication Data

US 2009/0156106 A1 Jun. 18, 2009

(30) Foreign Application Priority Data

Dec. 12, 2007 (DE) ..... 10 2007 055 778

(51) Int. Cl.
*B24B 23/00* (2006.01)

(52) U.S. Cl. ..... 451/359; 451/508

(58) Field of Classification Search ..... 451/359, 451/508, 509, 360

See application file for complete search history.

(56) References Cited

U.S. PATENT DOCUMENTS 2,331,861 A * 10/1943 Smith ..... 451/509
2006/0172668 A1 * 8/2006 Hofmann et al. ..... 451/359

FOREIGN PATENT DOCUMENTS

DE 42 38 466 C1 1/1994
DE 42 43 328 C1 6/1994
DE 43 05 317 A1 9/1994

* cited by examiner

*Primary Examiner* — Robert Rose
(74) *Attorney, Agent, or Firm* — Abelman, Frayne & Schwab

(57) ABSTRACT

A hand-held power tool has a drive spindle (2) rotatable about a rotational axis (A) and provided at its free end with a clamping flange (3) and a locking thread (4), a locking nut (7) tightenable on the locking thread (4) for securing a disc-shaped tool (5) between the clamping flange (3) of the drive spindle (2) and its clamping surface (6), and a safety spring (9) located between the disc-shaped tool (5) and an inner recess (8) formed in the clamping surface (6) of the locking nut (7), radially preloaded against the locking thread, and having at least one radial, outwardly projecting nose (10), with the disc-shaped tool (5) having at least one, opening radially inwardly and axially extending groove (11) associated with the at least one nose (10).

5 Claims, 1 Drawing Sheet

HAND-HELD POWER TOOL WITH LOCKING NUT

BACKGROUND OF THE INVENTION

1. Field of the Invention

The present invention relates to a hand-held power tool with a locking nut for securing a disc-shaped tool and, in particular, to angle grinder, hand-held jointer saw, or hand-held circular saw.

2. Description of the Prior Art

Conventional tool holders for a disc-shaped tool (under which in addition to flat discs, also plate-shaped tools are understood) frictionally secure the disc-shaped tool on the rotatable drive spindle between a clamping flange provided on the drive spindle and a locking nut that is screwed onto the drive spindle. The thread direction of the locking thread provided on the drive spindle is usually so selected that the locking nut automatically tightens upon actuation of the power tool or start up of the operation.

Contemporary hand-held power tools with safety routines provide for sudden braking of the drive spindle up to a complete stop. In order to reliably prevent an inadvertent loosening of the locking nut and/or of the disc-shaped tool in case when the locking nut becomes loose due to its inertia upon a sudden stop of the spindle, German Publication DE 42 38 466 discloses locking means that in addition to a locking nut, includes additional clamping means that applies pressure to the disc-shaped tool and is preloaded against a locking nut with a plate spring.

German Publication DE 42 43 328 discloses additional locking means that is connected with the drive spindle for joint rotation therewith and brakes, as a result, the inertia-induced relative rotation of the locking rut.

According to German Publication DE 43 05 317, the locking nut braking means is formed as a steel spring ring located in the locking nut and frictionally engaging the locking thread of the drive spindle.

An object of the present invention is to provide a reliable tool holder for a disc-shaped tool and that includes a locking nut.

SUMMARY OF THE INVENTION

This and other objects of the present invention, which will become apparent hereinafter are achieved by providing a hand-held power tool including a drive spindle rotatable about a rotational axis and provided at its free end with a clamping flange and a locking thread, a locking nut having a clamping surface and tightenable on the locking thread for securing a disc-shaped tool between the clamping flange of the drive spindle and the clamping surface of the locking nut, and a safety spring located between the disc-shaped tool and an inner recess formed in the clamping surface of the locking nut, radially preloaded against the locking thread, and having at least one radial, outwardly projecting nose, with the disc-shaped tool having at least one, opening radially inwardly and axially extending groove associated with the at least one nose of the safety spring.

With the radially projecting nose of a safety spring, which is frictionally secured on the locking thread of the drive spindle, the disc-shaped tool can be removed from the drive spindle only in associated circumferential positions, and in particular, not in an inertia-induced rotational condition relative to the drivespindle. Thus, the disc-shaped tool is axially secured on the drive spindle even in the case when the locking nut would have become loose on the drive spindle due to inertia.

Advantageously, the safety spring is formed of spring steel, which provides for a high elasticity of the safety spring.

Advantageously, the safety spring is formed of wire, which insures its technically simple manufacturing.

Advantageously, the safety spring is formed as almost completely annular spring ring, which permits to achieve a high static friction.

Advantageously, the safety spring has two opposite, projecting radially outwardly noses. Thereby, the associated disc-shaped tool can be ergonomically mounted/dismounted in at least two circumferential positions.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
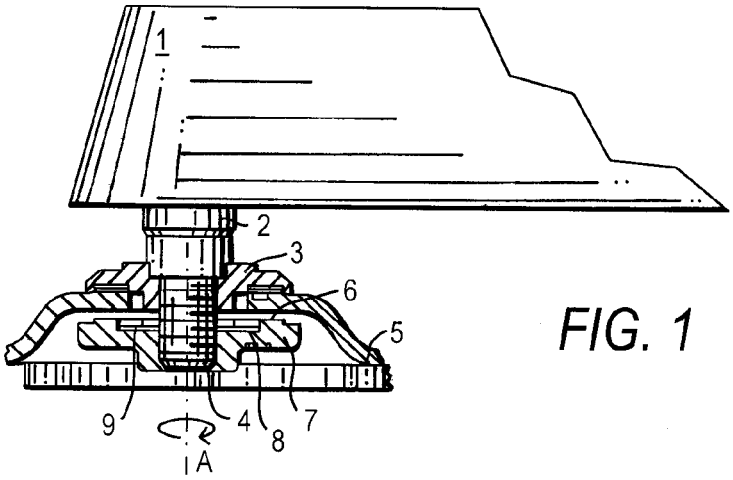
FIG. 1 a longitudinal cross-sectional view illustrating securing of a disc-shaped tool to a hand-held power tool.

A hand-held power tool 1, which schematically shown in FIG. 1, includes a drive spindle 2 rotatable about a rotational axis A, a clamping flange 3 formlockingly secured on an end of the drive spindle 2, and a locking thread 4. A disc-shaped tool 5 in form of a grinding disc is secured at the end of the drive spindle 2 with a clamping surface 6 of a locking nut 7 that is tightened on the locking thread 4. A safety spring 9, which is formed of a spring steel, is secured axially between the disc-shaped tool 5 and an inner recess 8 of the locking nut 7. The safety spring 9 is radially preloaded against the locking thread 4.

Figure 2:
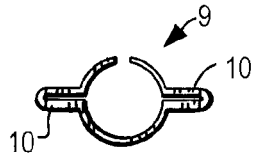
FIG. 2 a plan view of a safety spring.

The safety spring 9, which is shown in FIG. 2, is formed of a bent spring steel wire as an almost completely annular spring ring having two diametrically opposite, projecting radially outwardly noses 10.

Figure 3:
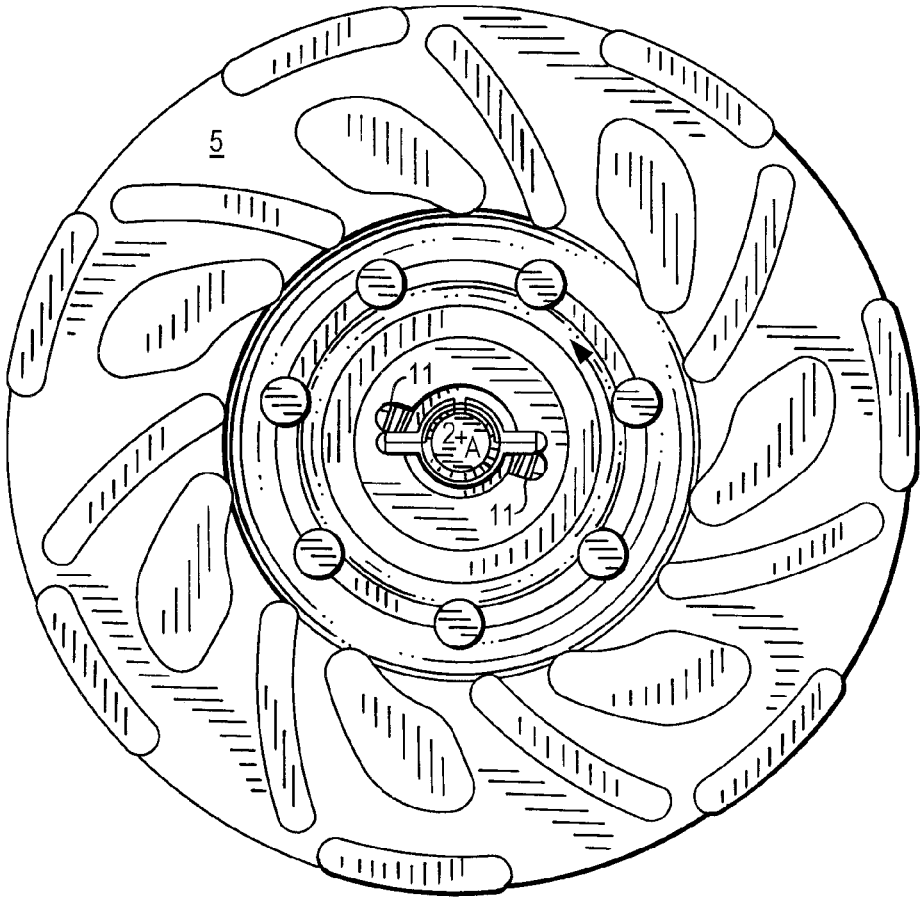
FIG. 3 a plan view of the disc-shaped tool with a detached nut.

As shown in FIG. 3, the disc-shaped tool 5 has two diametrically opposite, opening radially inwardly, axially extending grooves 11 associated with the two noses 10. In the inertia-dependent, freely rotatable, about the rotational axis A, condition of the disc-shaped tool 5 shown in FIG. 3, the grooves 11 are not exactly aligned with noses 10 in a plurality of angular positions (as shown) so that the disc-shaped tool 5 does not change its axial position on the stationary drive spindle 2.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising a drive spindle (2) rotatable about a rotational axis (A) and provided at a free end thereof with a clamping flange (3) and a locking thread (4); a locking nut (7) having a clamping surface (6) and tightenable on the locking thread (4) for securing a disc-shaped tool (5) between the clamping flange (3) of the drive spindle (2) and the clamping surface (6) of the locking nut (7); and a safety spring (9) located between the disc-shaped tool (5) and an inner recess (8) formed in the clamping surface (6) of the locking nut (7), radially preloaded against the locking thread (4), and having at least one radial, outwardly projecting nose (10), the disc-shaped tool (5) having at least one, opening radially inwardly and axially extending groove (11) associated with the at least one nose (10) of the safety spring (9).

2. A hand-held power tool according to claim 1, wherein the safety spring (9) is formed of spring steel.

3. A hand-held power tool according to claim 1, wherein the safety spring (9) is formed of wire.

4. A hand-held power tool according to claim 1, wherein the safety spring (9) is formed as an annular, spring ring.

5. A hand-held power tool according to claim 1, wherein the safety spring (9) has two opposite, outwardly projecting noses (10).

* * * * *